US006711823B2

(12) United States Patent
Floessholzer

(10) Patent No.: US 6,711,823 B2
(45) Date of Patent: Mar. 30, 2004

(54) PERSONAL CARE APPARATUS WITH A NOISE PROTECTION CAP

(75) Inventor: Hannes Floessholzer, St. Paul (AT)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/105,472

(22) Filed: Mar. 25, 2002

(65) Prior Publication Data

US 2002/0139610 A1 Oct. 3, 2002

(30) Foreign Application Priority Data

Mar. 27, 2001 (EP) ..... 01890096

(51) Int. Cl.[7] ..... B26B 19/30

(52) U.S. Cl. ..... 30/216; 30/210; 30/34.2; 30/45; D28/52

(58) Field of Search ..... 181/205, 198; 30/30, 32, 195, 210, 208, 209, 233, 286, 287, 228, 34.3, 349, 45, 58, 84, 216; D28/44, 45, 52; 206/351; 76/104.1

(56) References Cited

U.S. PATENT DOCUMENTS

| | | | | | |
|---|---|---|---|---|---|
| 2,864,162 | A | * | 12/1958 | Macdonald | 30/537 |
| 3,178,815 | A | * | 4/1965 | Madrid | 30/286 |
| 3,452,435 | A | * | 7/1969 | Holdt | 30/45 |
| 3,999,295 | A | * | 12/1976 | Du Bois | 30/195 |
| 5,185,931 | A | * | 2/1993 | Fujikawa et al. | 30/201 |
| 5,237,750 | A | * | 8/1993 | Nakano et al. | 30/131 |
| 6,098,289 | A | * | 8/2000 | Wetzel et al. | 30/43.92 |
| 6,151,780 | A | * | 11/2000 | Klein | 30/43.92 |
| 6,219,920 | B1 | * | 4/2001 | Klein | 30/43.92 |
| 6,226,869 | B1 | * | 5/2001 | Heintke et al. | 30/34.1 |
| 6,276,060 | B1 | * | 8/2001 | Faulstich et al. | 30/34.1 |
| 6,279,234 | B1 | * | 8/2001 | Chaouachi et al. | 30/201 |
| 6,308,414 | B1 | * | 10/2001 | Parsonage et al. | 30/43.91 |
| 6,317,982 | B1 | * | 11/2001 | Andrew | 30/34.1 |
| 6,381,849 | B2 | * | 5/2002 | Eichhorn et al. | 30/43.92 |
| 6,421,922 | B2 | * | 7/2002 | Beutel et al. | 30/216 |
| 6,442,840 | B2 | * | 9/2002 | Zucker | 30/42 |
| 6,502,309 | B2 | * | 1/2003 | De Vries et al. | 30/34.2 |

FOREIGN PATENT DOCUMENTS

| | | | | |
|---|---|---|---|---|
| DE | 20021185 U | | 3/2001 | A45D/26/00 |
| DE | 20021185 U1 | * | 3/2001 | A45D/26/00 |
| EP | 0585621 A1 | | 3/1994 | A45D/26/00 |
| JP | 52150157 A | * | 12/1977 | B26B/19/38 |
| JP | 05057066 A | * | 3/1993 | B26B/19/04 |

* cited by examiner

*Primary Examiner*—Robert Nappi
*Assistant Examiner*—Eduardo Colon Santana

(57) ABSTRACT

A personal care apparatus (1) with a housing (2) and with apparatus parts (6) for treating body parts of a person, which apparatus parts (6) are provided in a head region (5) of the personal care apparatus (1), is fitted in its head region (5) with a noise protection cap (9) which is designed with a closed circumference and which has a cap edge (12) which can be placed on the skin of a person during operation of the personal care apparatus (1) in order to fulfill a noise protection function.

13 Claims, 4 Drawing Sheets

PERSONAL CARE APPARATUS WITH A NOISE PROTECTION CAP

TECHNICAL FIELD OF THE INVENTION

The invention relates to a personal care apparatus with a housing and with apparatus parts for treating body parts, which apparatus parts are provided in a head region of the personal care apparatus.

BACKGROUND OF THE INVENTION

A personal care apparatus as set forth above is disclosed, for example, in patent document EP 0 585 621 A1. This known personal care apparatus is what is termed a depilation apparatus which is fitted with what is termed a depilation cylinder that is fitted with adjustably supported depilation disks as apparatus parts for treating body parts, specifically for removing hair from body parts, which depilation disks can be adjusted relative to one another and, in the process, can additionally be driven into rotation and can be brought into a clamped position in a periodically recurring sequence in which they ensure that hairs are plucked out. The known depilation means for reducing the operating noise of the depilation apparatus apparatus has in the region of the depilation disks. The operating noise can certainly be somewhat reduced by these means, but the noise occurring when the depilation disks collide, which is generated when the depilation disks are brought into their clamped position, can in practice be influenced inadequately or not at all by these means, and so a noise level perceived as unpleasant by a person will arise during operation of the known depilation apparatus.

SUMMARY OF THE INVENTION

The invention has for its object in the case of a personal care apparatus the type described in the opening paragraph, to avoid the state of affairs indicated above and to improve an improved personal care apparatus.

In order to achieve the object set forth above, a personal care apparatus in accordance with the invention comprises inventive features such that a personal care apparatus in accordance with the invention can be defined as follows.

A personal care apparatus with a housing and with apparatus parts for treating body parts, which apparatus parts are provided in a head region of the personal care apparatus, wherein a noise protection cap is connected to the personal care apparatus in its head region, which cap is designed with a closed circumference and terminates in a cap edge which can be placed on the skin of a person during operation of the personal care apparatus.

It is achieved in a structurally simple way as a result of the presence of the features in accordance with the invention that during operation of a personal care apparatus in accordance with the invention the noise caused by the apparatus parts for treating body parts cannot be issued at all to the surroundings of the personal care apparatus, or can be issued only in a greatly attenuated way, as a result of which during operation of a personal care apparatus in accordance with the invention the person using the personal care apparatus is unable to perceive a noise level which disturbs him/her, because the noise protection cap suppresses the emergence of the sound generated by the apparatus parts for treating body parts.

In a personal care apparatus in accordance with the invention, it has proved to be very advantageous when the noise protection cap consists at least for the major part of a transparent material. This ensures that during operation of a personal care apparatus in accordance with the invention there is substantially no impairment of the view of the apparatus parts for treating body parts through the noise protection cap.

In a personal care apparatus in accordance with the invention, it has furthermore proved to be advantageous when the noise protection cap is detachably connected to the personal care apparatus and can be removed from the personal care apparatus. This is advantageous for cleaning the head region of the personal care apparatus in a simple way unhindered by the noise protection cap. Moreover, the advantage is thereby provided that a personal care apparatus in accordance with the invention can also be put into operation without a noise protection cap whenever this is desired.

In a personal care apparatus in accordance with the invention, it has proved to be very advantageous when the noise protection cap is resiliently mounted on the personal care apparatus, spring means being provided for this purpose as defined in claim 4. It is ensured hereby that the noise protection cap always bears effectively with its cap edge on the body parts to be treated.

With regard to holding the cap edge of the noise protection cap effectively against the body parts to be treated, it has also proved to be very advantageous when the noise protection cap is pivotably connected to the personal care apparatus. It is particularly advantageous in this context when the noise protection cap is connected to the personal care apparatus in a wobbling fashion, that is to say can be pivoted not just about one pivot axis, but about at least two pivot axes.

In a personal care apparatus in accordance with the invention wherein during operation of the personal care apparatus the noise protection cap can be moved in a specific operating direction over the body parts to be treated, i.e. over the skin of a person, it has proved to be particularly advantageous when the noise protection cap is connected to the personal care apparatus such that it can pivot about a pivot axis which is substantially at right angles to the operating direction. This ensures that the noise protection cap bears with its cap edge in a particularly effective way on the body parts to be treated. However, it has also proved to be very advantageous when the noise protection cap is connected to the personal care apparatus such that it can pivot about a pivot axis which is essentially parallel to the operating direction, also for achieving that the noise protection cap will bear with its cap edge effectively on body parts.

A personal care apparatus according to the invention may be formed by a shaver or by a massage device. It has proved to be particularly advantageous when the personal care apparatus is formed by a depilation apparatus which has adjustable apparatus parts for depilation as is disclosed per se in the cited patent document EP 0 585 621 A1. It has proved to be particularly advantageous in such a depilation apparatus to provide a noise protection cap which always remains with its cap edge held in operational contact with the body parts to be treated, i.e. with the body parts to be depilated, in particular because the adjustable apparatus parts for depilation in a depilation apparatus themselves generate a noise perceived as unpleasant, which noise causes a negative psychological effect for most people using such a depilation apparatus a negative psychological effect, specifically the effect that this noise engenders an increased sensation of pain.

In a personal care apparatus formed by a depilation apparatus, it has proved to be very advantageous when the noise protection cap is additionally fitted with means for raising hairs and/or with means for aligning hairs. This ensures that the noise protection cap fulfills at least one additional function.

The above and further aspects of the invention will become apparent from the subsequent description of embodiments and will be explained below with reference to these embodiments.

BRIEF DESCRIPTION OF THE DRAWINGS

The invention will be described in more detail below with reference to four embodiments shown in the drawings, to which, however, the invention is not limited.

DETAILED DESCRIPTION OF THE PRESENTLY PREFERRED EMBODIMENTS

Figure 1:
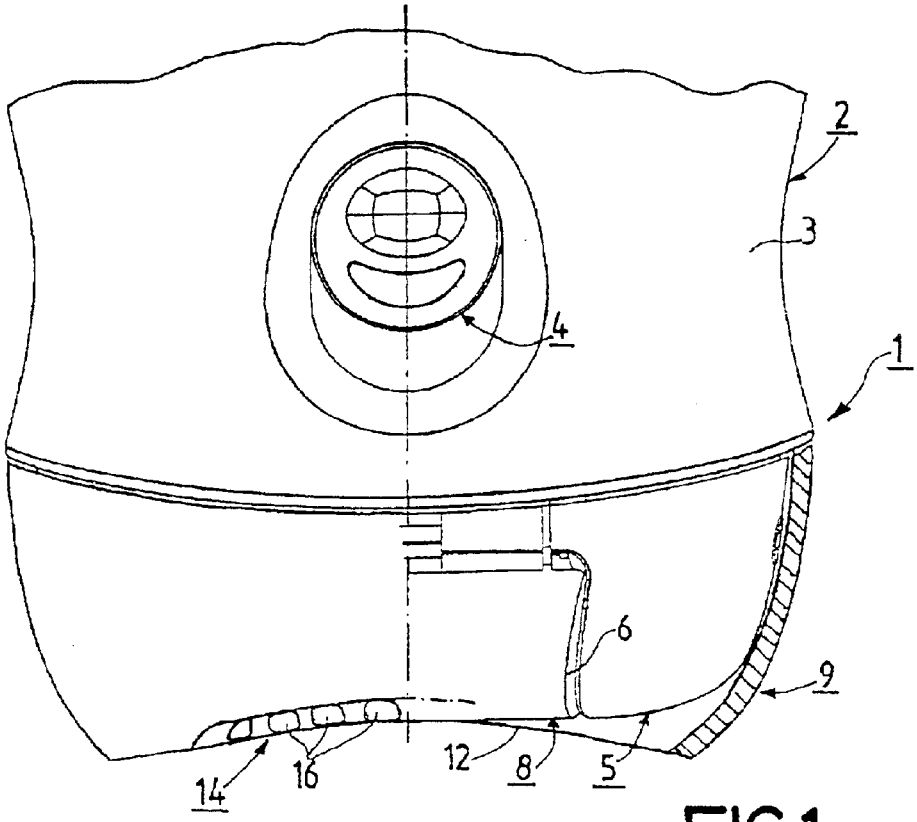
FIG. 1 shows, in front elevation and partly in cross-section, a personal care apparatus, specifically a depilation apparatus in accordance with a first embodiment of the invention.

FIG. 1 shows a personal care apparatus 1, which is constructed as a depilation apparatus 1 and is denoted below in brief as apparatus 1. The apparatus 1 has a housing 2, which is shown in part only in FIG. 1. A switch 4 for switching the apparatus 1 on and off is provided on a main wall 3 of the housing 2.

The apparatus 1 has a head region 5. The head region 5 is to be understood to be the operating region of the apparatus 1, by means of which head region 5 the apparatus 1 can be brought into operational contract with the body parts to be treated. The head region 5 is formed by what is termed a depilation head 5, which is detachably connected to the remaining part of the apparatus 1. Adjustable apparatus parts 6 for depilation are provided in the head region 5. The adjustable apparatus parts 6 are formed in this case by what are termed depilation disks 6, which are mounted rotatably with respect to an axis of rotation 7, and which can be pivoted with respect to pivot axes which run essentially perpendicular to the axis of rotation 7, specifically in such a way that in each case two juxtaposed depilation disks 6 can be swiveled toward one another and away from one another, the depilation disks 6 being brought into a clamping position in which they can grip a hair to be pulled from the skin when pivoting toward one another, which hair is then withdrawn from the skin by the rotating drive of the depilation disks 6. This has long been known to those skilled in the art. During the operation as described above, in moving the depilation disks 6, and in particular in pivoting the depilation disks 6 toward one another, there is a sudden mutual contact between two respective depilation disks 6 which is accompanied by a relatively loud operating noise. It remains to mention that the juxtaposed depilation disks 6 form what is termed a depilation cylinder 8, as is indicated diagrammatically in FIG. 1.

Figure 2:
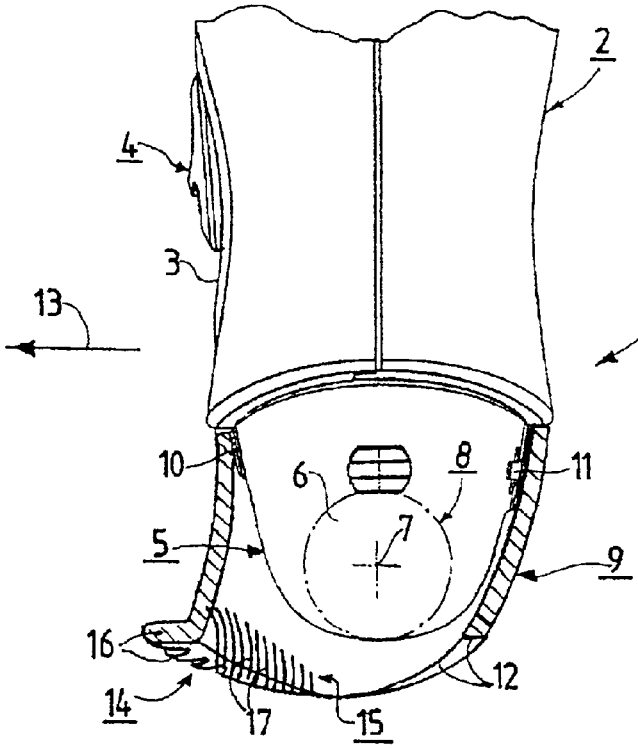
FIG. 2 is a side elevation, partly in cross-section, of the depilation apparatus of FIG. 1.

A noise protection cap 9 advantageously provided in the apparatus 1, which cap is connected to the apparatus 1 in the head region 5 of the apparatus 1, specifically in that the noise protection cap 9 is snapped home or plugged onto the head region 5 and is retained there by holding parts 10 and 11, which holding parts 10 and 11 retain the noise protection cap 9 by utilizing friction and locking. The noise protection cap 9 is designed with a closed circumference. The noise protection cap 9 terminates in a cap edge 12 which is likewise annularly closed and which can be placed on the skin or on the body part to be treated of a person during operation of the apparatus 1. The noise protection cap 9 here consists of a transparent material, and so the view of the depilation disks 6 is not impaired. Retention of the noise protection cap 9 by the holding parts 10 and 11 means that the noise protection cap 9 is detachably connected to the apparatus 1 and can be removed from the apparatus 1. Consequently, during operation of the apparatus 1, the apparatus 1, and therefore the noise protection cap 9 as well, can be moved over the skin of a person in an operating direction 13, indicated with an arrow FIG. 2.

The noise protection cap 9 is provided with means 14 for aligning hairs and with means 15 for raising hairs in its region situated ahead of the depilation disks 6 in the operating direction 13. The means 14 for aligning hairs are formed here by teeth 16 of comb-like design which project from the noise protection cap 9 in the region of the cap edge 12. The teeth 16 of comb-like design ensure alignment of hairs when the apparatus 1 is moved over the skin of a person. The means 15 for raising hairs are formed by bristles 17 which are connected to the noise protection cap 9 and project from the noise protection cap 9 in the interior thereof, specifically in such a way that, when the noise protection cap 9 is placed on the skin of a person and moved in the operating direction 13, they can come into operational contact with the hairs in such a way that they ensure raising of the hairs.

Figure 3:
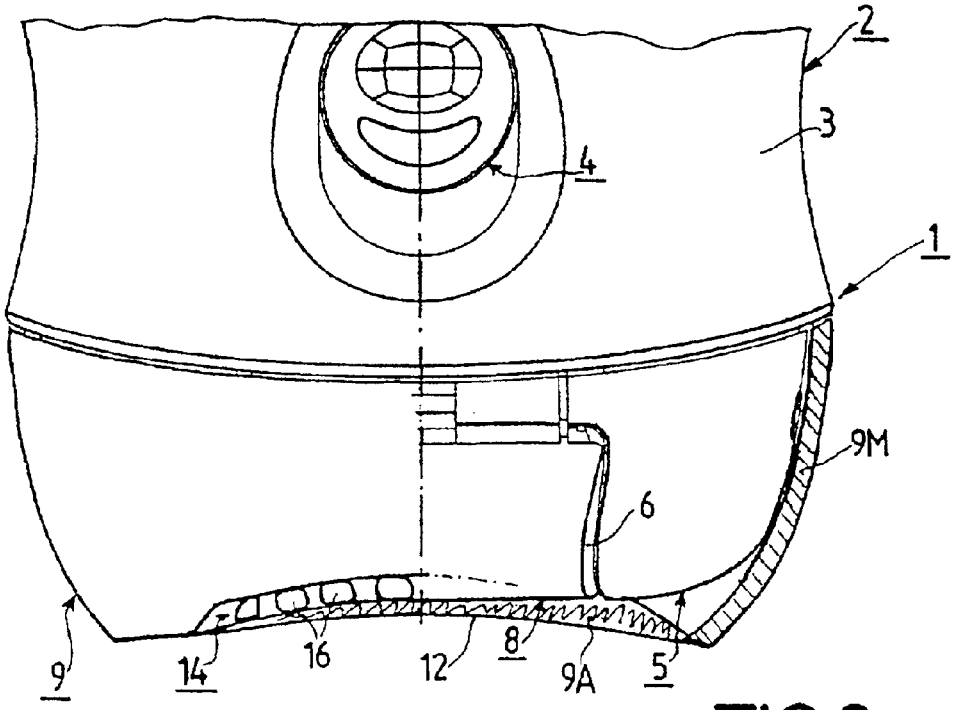
FIG. 3 shows, in a way similar to FIG. 1, a depilation apparatus in accordance with a second embodiment of the invention.
Figure 4:
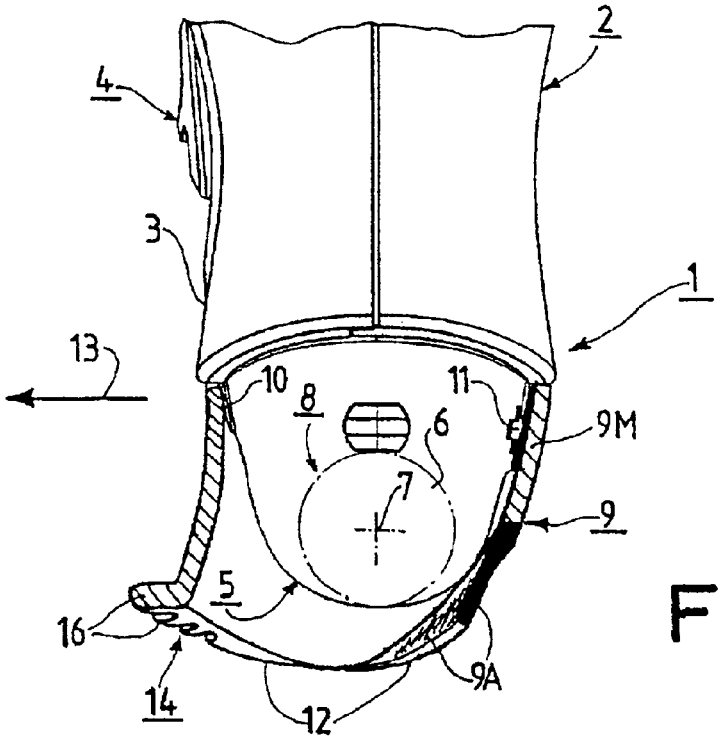
FIG. 4 shows, in a way similar to FIG. 2, the depilation apparatus of FIG. 3.

FIGS. 3 and 4 show a further apparatus 1, which is likewise a depilation apparatus. In the apparatus 1 of FIGS. 3 and 4, a noise protection cap 9 is provided which is manufactured by what is termed a two-component injection molding method, a main part 9M of the noise protection cap 9 consisting of a transparent material, just as in the apparatus 1 FIGS. 1 and 2, whereas an edge part 9A of the noise protection cap 9, situated behind the depilation disks 6, seen in the operating direction 13, consists of an opaque rubbery material. The edge part 9A is therefore of substantially softer consistency than the remaining main part 9M of the noise protection cap 9. Because of the soft nature of the edge part 9A, the noise protection cap 9 bears with its cap edge 12 effectively on the skin of a person, such that an effective sealing, and therefore an effective noise protection, are ensured.

Figure 5:
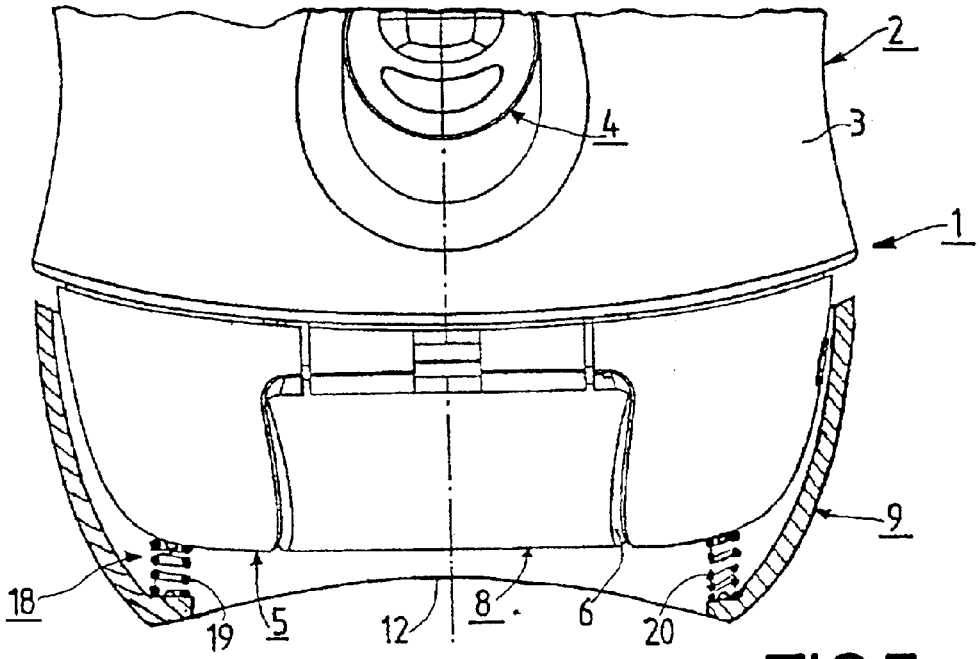
FIG. 5 shows, in a way similar to FIGS. 1 and 3, a depilation apparatus in accordance with a third embodiment of the invention.
Figure 6:
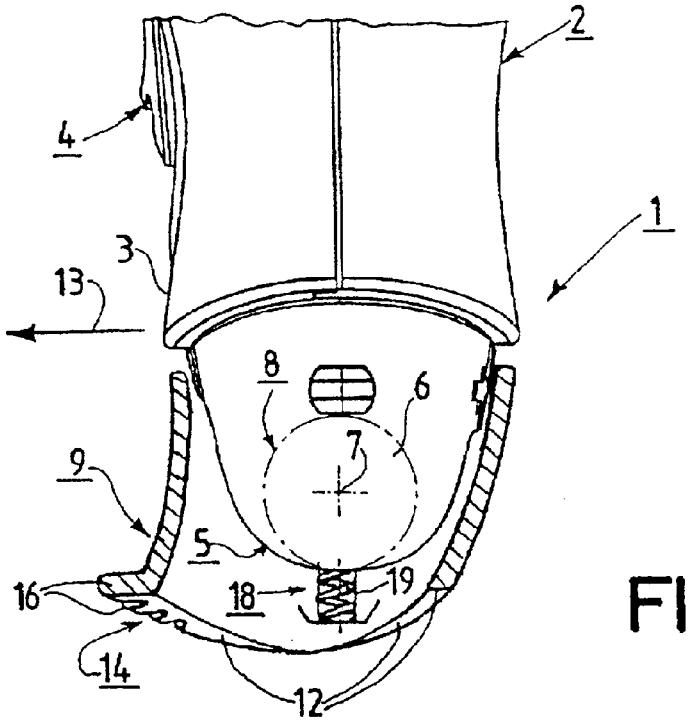
FIG. 6 shows, in a way similar to FIGS. 2 and 4, the depilation apparatus in accordance with FIG. 5.

FIGS. 5 and 6 show a further apparatus 1 which is likewise constructed as a depilation apparatus. In the apparatus 1 of FIGS. 5 and 6, spring means 18 are provided which cooperate with the noise protection cap 9 and which spring-load the noise protection cap 9 in a direction away from the apparatus 1. In this case, the spring means 18 are formed by two compression springs 19 and 20. Each of the two compression springs 19 and 20 is firmly connected by one end to the head region 6 of the apparatus 1, and by the other end to the noise protection cap 9, such that the compression springs 19 and 20 are also provided and utilized, for retaining the noise protection cap 9 on the apparatus 1. The provision of the spring means 18 advantageously results in the fact that the noise protection cap 9 can be adjusted against the force of the spring means 18 when placed on the skin of a person. This is very advantageous for keeping the cap edge 12 effectively and permanently pressed against the skin or a body part of a person.

Figure 7:
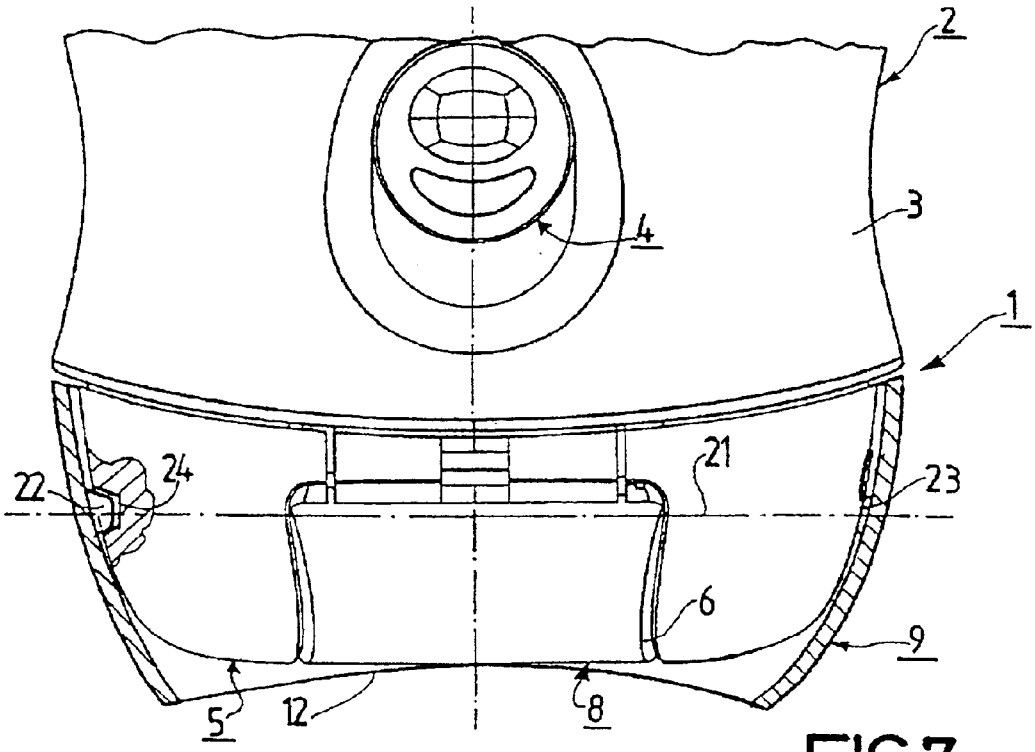
FIG. 7 shows, in a way similar to FIGS. 1, 3 and 5, a depilation apparatus in accordance with a fourth embodiment of the invention.
Figure 8:
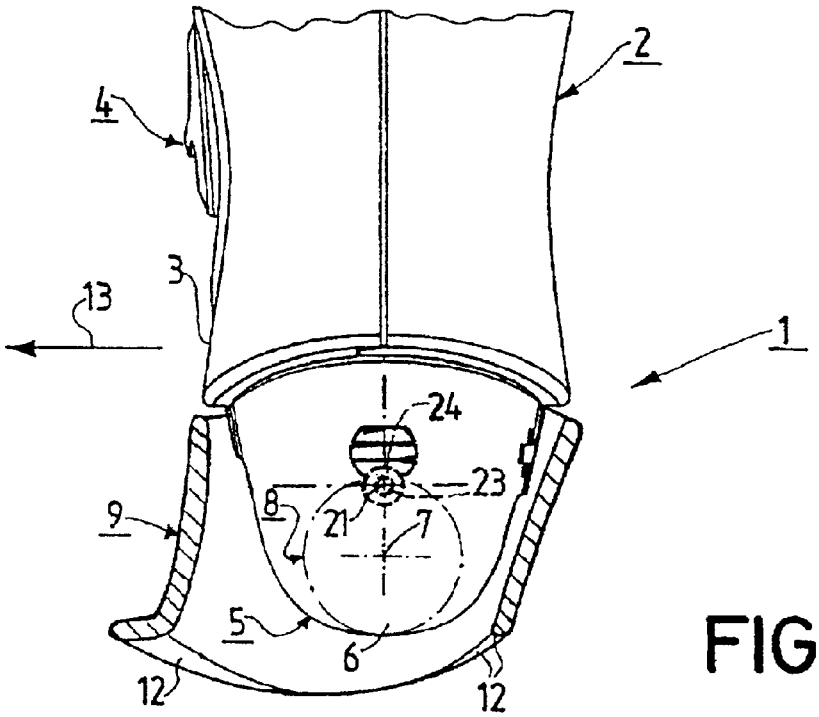
FIG. 8 shows, in a way similar to FIGS. 2, 4 and 6, the depilation apparatus of FIG. 7.

FIGS. 7 and 8 show a further apparatus 1, which is likewise formed by a depilation apparatus. In the apparatus 1 of FIGS. 7 and 8, the noise protection cap 9 is pivotably connected to the apparatus 1, the design being such that the noise protection cap 9 can be pivoted about a pivot axis 21 which is substantially perpendicular to the operating direction 13. The pivot axis 21 is obtained in this case by providing in the interior of the noise protection cap 9 two bearing pins 22 and 23 opposite to one another, of which each bearing pin 22 or 23 projects into a bearing cutout 24 in the head region 5 of the apparatus 1. The bearing pins 22 and 23 and the bearing cutouts 24 at the same time form snap connections here, by means with the aid of which the noise protection cap 9 is detachably connected to the apparatus 1. The pivotable bearing of the noise protection cap 9 on the apparatus 1 likewise permits the noise protection cap 9 to bear effectively with its cap edge 12 on the skin of a person.

It may be mentioned that a noise protection cap 9 may alternatively be mounted such that it can wobble with respect to a personal care apparatus 1, it then being possible to insert an adapter between the noise protection cap 9 and the head region 5 of the apparatus 1, the noise protection cap 9 being connected to the adapter such that it can pivot about a first pivot axis, and the adapter being connected to the head region 5 such that it can pivot about a second pivot axis perpendicular to the first pivot axis.

It may further be mentioned that an apparatus 1 may alternatively have all the measures explained with reference to the apparatuses 1 described above combined with one another and with reference to the noise protection cap 9, in which case a noise protection cap 9 mounted such that it can pivot or wobble is held adjustably against the force of spring means 18, and the noise protection cap 9 is fitted with comb teeth 16 and bristles 17 as well as a rubbery edge part 9A.

What is claimed is:

1. A personal care apparatus (1) with a housing (2) and with apparatus parts (6) for treating body parts, which apparatus parts (6) are provided in a head region (5) of the personal care apparatus (1), wherein a noise protection cap (9) is detachably and pivotally connected to the personal care apparatus (1) by bearing pins (22, 23) in its head region (5) which cap is designed with a closed circumference and terminates in a cap edge (12) which is placed on the skin of a person during operation of the personal care apparatus (1).

2. The personal care apparatus (1) as claimed in claim 1, wherein the noise protection cap (9) consists at least for the major part of a transparent material.

3. A personal care apparatus (1) as claimed in claim 1, wherein spring means (18) are provided which cooperate with the noise protection cap (9) and which load the noise protection cap (9) in a direction away from the personal care apparatus (1), and wherein the noise protection cap (9) can be displayed against the force of the spring means (18) upon being placed on the skin of a person.

4. A personal care apparatus (1) as claimed in claim 1, wherein the noise protection cap (9) is connected to the personal care apparatus (1) in a wobbling manner.

5. A personal care apparatus (1) as claimed in claim 1, wherein the noise protection cap (9) can be moved over the skin of a person in an operating direction (13) during operation of the personal care apparatus (1), and wherein the noise protection cap (9) is connected to the personal care apparatus (1) such that it can pivot about a pivot axis (21) which is substantially at right angles to the operating direction (13).

6. A personal care apparatus (1) as claimed in claim 1, wherein the personal care apparatus (1) is formed by a depilation apparatus (1) which has adjustable apparatus parts (6) for depilation.

7. A personal care apparatus (1) as claimed in claim 6, wherein the noise protection cap (9) can be moved over the skin of a person in an operating direction (13) of the depilation apparatus (1) during operation of the depilation apparatus (1), and the noise protection cap (9) is provided with means (15) for raising hairs in its wherein region situated ahead of the apparatus parts (6) for depilation, seen in the operating direction (13).

8. A personal care apparatus (1) as claimed in claim 6, wherein the noise protection cap (9) can be moved over the skin of a person in an operating direction (13) of the depilation apparatus (1) during operation of the depilation apparatus (1), and wherein, ahead of the apparatus parts (6) for depilation, the noise protection cap (9) is provided with means (14) for aligning hairs in its region situated, seen in the operating direction (13).

9. A personal care apparatus (1) comprising:

a housing (2); p1 a head region (5) of the housing, wherein the head region comprises apparatus part (6);

a noise protection cap (9) detachably and pivotally connected to the personal care apparatus (1) by bearing pins (22, 23), wherein said noise protection cap comprises a closed circumference and terminates in a cap edge (12) and wherein an edge part (9A) of the noise protection cap (9) comprises a material of substantially softer consistency than the remaining main part (9N) of the noise protection cap (9);

and wherein the noise protection cap edge is placed on the skin of a person during operation of the personal care apparatus (1).

10. The personal care apparatus of claim 9, wherein the noise protection cap (9) comprises a transparent material.

11. The personal care apparatus of claim 9, further comprising means (15) for raising hairs.

12. The personal care apparatus of claim 9, wherein the noise protection cap (9) is connected to the personal care apparatus (1) such that the noise protection cap (9) can pivot about a pivot axis (21) which is substantially at right angles to an operating direction (13).

13. The personal care apparatus of claim 9, wherein the noise protection cap is connected to the head region (5) of the personal care apparatus (1) by a method selected from the group consisting of snapping, plugging, friction retaining and locking.

* * * * *